US005147234A

United States Patent [19]

Brug

[11] Patent Number: 5,147,234

[45] Date of Patent: Sep. 15, 1992

[54] HEEL-BINDING DEVICE

[75] Inventor: Byron L. Brug, 337 Honono St., Honolulu, Hi. 96825

[73] Assignees: Byron Lance Brug; Dennis Brian Kirk, both of Pearl City, Hi.

[21] Appl. No.: 653,013

[22] Filed: Feb. 8, 1991

[51] Int. Cl.[5] ..... B63B 35/85
[52] U.S. Cl. ..... 441/70; 280/619
[58] Field of Search ..... 441/68, 79, 74, 75; 280/14.2, 619

[56] References Cited

U.S. PATENT DOCUMENTS

| | | | |
|---|---|---|---|
| 1,476,905 | 12/1923 | Mardus . | |
| 2,130,693 | 9/1938 | Nashe et al. | 280/619 |
| 2,153,809 | 4/1939 | Meis | 280/619 |
| 4,116,462 | 9/1978 | Buel | 280/619 |
| 4,969,655 | 11/1990 | Kate | 441/74 |

*Primary Examiner*—Jesus D. Sotelo
*Attorney, Agent, or Firm*—Martin E. Hsia

[57] ABSTRACT

A heel-binding device having an elastic member connected to two anchors which are connected to a sporting board directly, or indirectly via connections to a foot strap which is itself connected to said sporting board.

56 Claims, 3 Drawing Sheets

HEEL-BINDING DEVICE

BACKGROUND OF THE INVENTION

This invention relates to a device for releasably binding a user's heel to various sporting boards, including, but not limited to, skiboards and windsurfing boards. The device provides beginning users greater confidence in the use of sporting boards, and provides advanced users with increased ability and safety in performing stunts with sporting boards. One embodiment of the invention is designed to be easily retrofitted onto existing sporting boards.

Foot straps for retaining a user's feet on a sporting board are known. However, foot straps alone are not sufficient for certain sporting board activities, especially with the development of high performance sporting boards, including high performance skiboards designed to be pulled by motorboats and designed to permit a wider range of stunts than traditional water skis. Thus, the need arose for a stretchable and releasable heel-binding device. Stretchability was necessary in order to comfortably retain a user's bare foot and to absorb the stresses of skiboarding. Releasability was necessary in order to prevent injury to a skiboard user from the skiboard during a headfirst fall, the most common type of fall for a skiboarder. Ease of adjustment was necessary in order to adjust to the different sizes of different users' feet. Further, any heel retaining device needed to be able to function reliably in a salt water environment.

Although many heel retaining devices are known, none provides the combination of properties necessary for use with skiboards or other sporting boards.

U.S. Pat. No. 4,969,655 to Katz discloses a plastic heel strap having two portions joined together by nuts and bolts set through holes in each portion of the plastic strap to permit proper adjustment. This strap does not provide stretchability, releasability or ease of adjustment to the wearer.

U.S. Pat. No. 2,153,809 to Meis discloses a non-stretchable heel strap having two portions joined together with a traditional buckle-and-hole system for proper adjustment. This strap was designed specifically for use with a ski binder for snow skis, and does not provide stretchability or releasability.

U.S. Pat. No. 4,116,462 to Buel discloses a strap made of gum rubber attached to a plate which is laced to the top of a ski boot. The strap forms a loop attached to the top of the boot. A ski is provided with a fixed heel locating member over which the loop is also engaged. The engaged loop pulls backward on the heel of the ski boot, retaining the boot on the ski. This device, while stretchable, does not pull forward on the ski boot, requires a shoe with laces for attachment, requires a separate plate for attachment and requires a separate heel locating member attached to the ski.

U.S. Pat. No. 1,476,905 to Mardus discloses a heel strap attached to a foot strap attached to a water shoe. This heel strap does not appear to be either stretchable or releasable and in fact, from the drawings, appears to be made of metal.

None of these references discloses the required degree of stretchability, ease of adjustment, automatic release in case of a headfirst fall, and situational release in other types of falls needed for skiboard use. Katz, Meis and Buel relate to retaining a shoe or boot, not a person's heel. Mardus does not disclose a stretchable heel strap.

It is therefore an object of this invention to provide a comfortable heel-binding device which pulls a user's foot forward under a foot strap to securely bind the user's foot to a sporting board, thereby providing the user with increased confidence and ability to perform an increased number of stunts.

It is a further object of this invention to provide a heel-binding device which can be easily adjusted to the user's foot for proper fit.

It is a further object of this invention to provide a heel-binding device with the ability to cushion the user's foot against acceleration and deceleration of the sporting board without discomfort or injury and without undesirably releasing the foot from the sporting board.

It is a still further object of this invention to provide a heel-binding device with the ability to automatically release the user's foot in the event of an accident in which the user is pulled headfirst over the top of the skiboard in order to prevent injury to the user from the skiboard.

It is a still further object of this invention to provide the capability of releasing in any fall in which excessive stress is applied in order to reduce the risk of injury to the user.

It is a still further object of this invention to provide a heel-binding device that can withstand the salt water environment and severe physical stresses imposed by the sport of skiboarding and other water sports in which a user moves at high speeds across salt water.

SUMMARY OF THE INVENTION

These and other objects are obtained by a heel-binding device comprising an elastic member attached to two anchors which, in turn, are attached directly or indirectly onto the skiboard or the foot strap.

In one preferred embodiment suitable for retrofitting to boards with existing foot straps retained by screws, the elastic member comprises latex tubing formed into an elongated loop, with anchors of nylon webbing, attached to the two ends of the loop. Alternatively, anchors of nylon webbing can be attached at both ends of a length of unlooped tubing. The anchors are preferably provided with multiple grommets so that they can be adjustably attached directly to the skiboard by the screws that retain the existing foot straps. Preferably, the latex tubing is covered by a sleeve, preferably of neoprene rubber, for comfort and a tab of nylon webbing is attached for ease of adjustment. Other materials can be used for the elastic member (for example, a length of latex rubber that is not hollow) and the sleeve (for example, stretchable synthetic cloth, such as nylon, Lycra® or Spandex®).

Another preferred embodiment includes a combination foot strap and heel binding system using the same elastic member and anchors in which the foot strap and heel binding system are integrated together. One anchor is attached directly to one side of the foot strap and the other anchor can be releasably fastened to a buckle attached to the other side of the foot strap. Other fastening systems, such as hook and loop fasteners (such as VELCRO®) also can be used to provide adjustable and releasable fastening of the elastic member to the foot strap.

DETAILED DESCRIPTION OF THE PREFERRED EMBODIMENT

Figure 1:
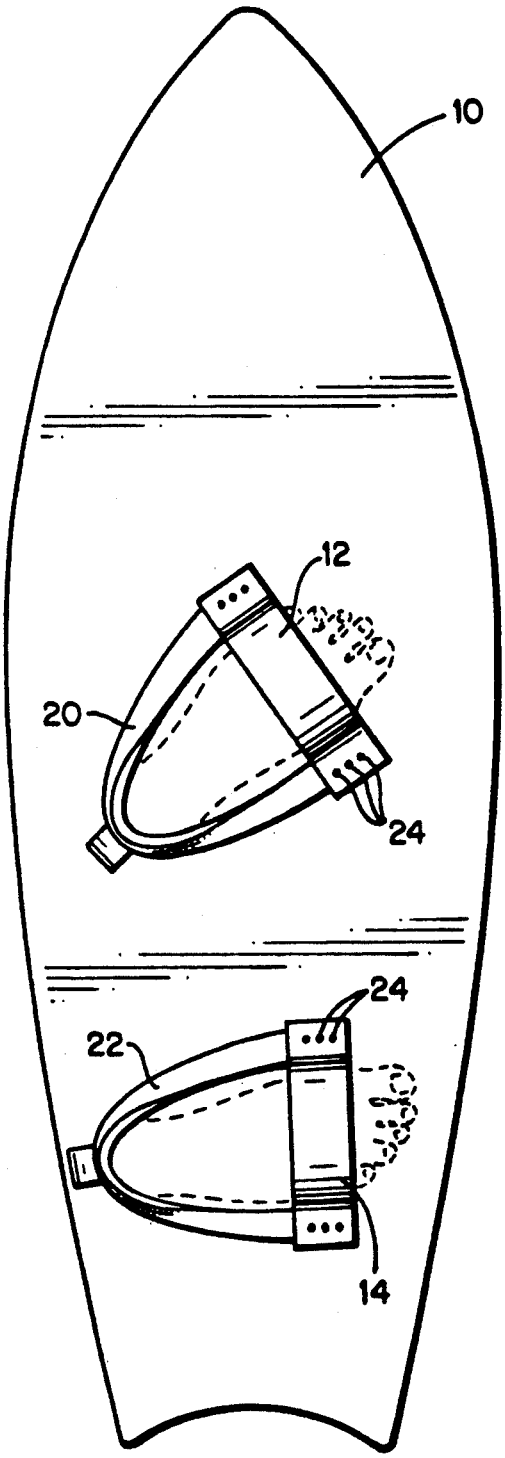
FIG. 1 is a top plan view of a skiboard showing a preferred embodiment of the invention attached to the skiboard underneath a foot strap. The user's feet are shown in phantom line to show environment only.

Referring to FIG. 1, a preferred embodiment generally is shown retrofitted to a skiboard 10 of any conventional design and material. Front foot strap 12, rear foot strap 14, front heel-binding device 20 and rear heel-binding device 22 are mounted on the top side of skiboard 10 by screws 24, as shown. The front heel-binding device 20 and rear heel-binding device 22 have been retrofitted onto the skiboard 10 by removing the screws 24, thereby detaching the front foot strap 12 and rear foot strap 14, positioning the front heel-binding device 20 and the rear heel-binding device 22 on the skiboard 10 under the front foot strap 12 and the rear foot strap 14, and reattaching the front foot strap 12 and the rear foot strap 14 with screws 24 passing through grommets 56 (shown in FIG. 2).

Figure 2:
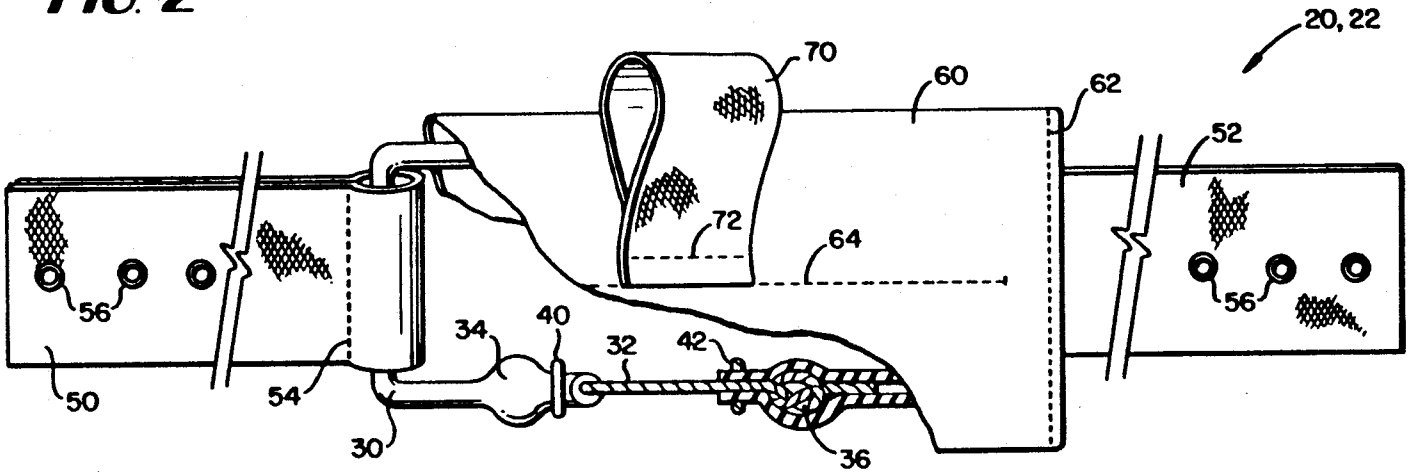
FIG. 2 is a partially cut away elevational view of a preferred embodiment of the invention.

Referring to FIG. 2, a preferable construction of front heel-binding device 20 and rear heel-binding device 22 is shown. The ends of a length of elastic material, preferably hollow latex tubing, are connected to each other by any conventional means to form an elastic loop 30. Preferably knots 34 and 36 are tied at the ends of a nylon cord 32 and inserted into the two ends of the tubing, as shown, and retained in place by nylon zip-ties 40 and 42 tightened over the elastic material abutting knots 34 and 36, respectively. Zip-ties 40 and 42 (sometimes referred to as cable ties and manufactured by Dennison Manufacturing Company) are of conventional construction, preferably a length of plastic having a square hole formed at one end and multiple serrated projections along its length so that the plastic and projections can be pulled through the hole for tightening, but the projections prevent the plastic from loosening (in side view, the projections have a modified sawtooth appearance).

Anchors 50 and 52 are preferably formed by passing any conventional material, preferably nylon webbing, through loop 30, folding such material over on itself, and joining the folded-over layers together, preferably by stitching nylon thread 54 abutting loop 30, as shown. Preferably, three grommets 56, of any conventional material, preferably brass, nylon, vinyl or plastic, are inserted through both layers of anchor 50 and anchor 52 in order to permit the heel-binding device 20 or 22 to be retrofitted to skiboard 10 by screws 24 (see FIG. 1) and to adjust the desired length of heel-binding device 20 or 22.

A sleeve 60, preferably comprised of rubber, preferably neoprene rubber, encloses loop 30 and is attached to anchors 50 and 52 by sewing, preferably with nylon thread 62. A line of stitching, again preferably of nylon thread 64, is preferably made down the middle of sleeve 60 inside loop 30 connecting sleeve 60 to itself and defining two tubes enclosing loop 30.

Finally, in the preferred embodiment, a tab 70, of conventional material, preferably nylon webbing folded over sleeve 60, is attached, preferably by attaching the webbing to the outside of each layer of sleeve 60 near stitching 64 at a point approximately midway between the two stitchlines 62. The tab 70 is preferably attached by nylon thread 72 which penetrates both layers of sleeve 60 and both ends of tab 70. The tab makes it easier to put on and adjust heel-binding device 20 and 22.

The preferred materials provide strength, durability and resistance to corrosion in the salt water environment of skiboarding and other high-speed waterboard sports.

Figure 3:
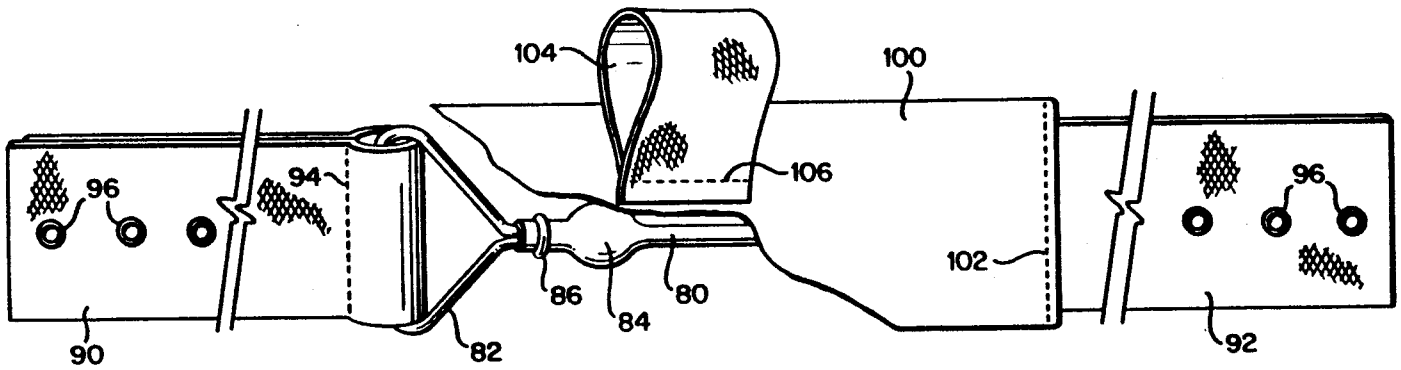
FIG. 3 is a partially cut away elevational view of an alternative embodiment of the invention.

Referring to FIG. 3, an alternative embodiment of the heel-binding device is shown. A single strand 80, comprised of any elastic material but preferably of hollow latex tubing, is connected to anchors 90 and 92 by any conventional means. Preferably, the ends of a cord 82, preferably comprising nylon, are tied together to form a loop having a knot 84 which is inserted into an end of strand 80. The knot 84 is preferably retained in place by nylon zip-tie 86 tightened over the strand 80 abutting knot 84.

Anchors 90 and 92 are preferably formed as in the embodiment described above, except that they are passed through the looped cord 82 instead of a loop 30.

Sleeve 100, comprised of rubber, preferably of neoprene rubber, surrounds strand 80 and loop 82 and is attached to anchors 90 and 92 by sewing, preferably with nylon thread 102.

Tab 104 is preferably formed as in the embodiment described above, except that it is attached above or below strand 80 as it runs through sleeve 100.

Figure 4:
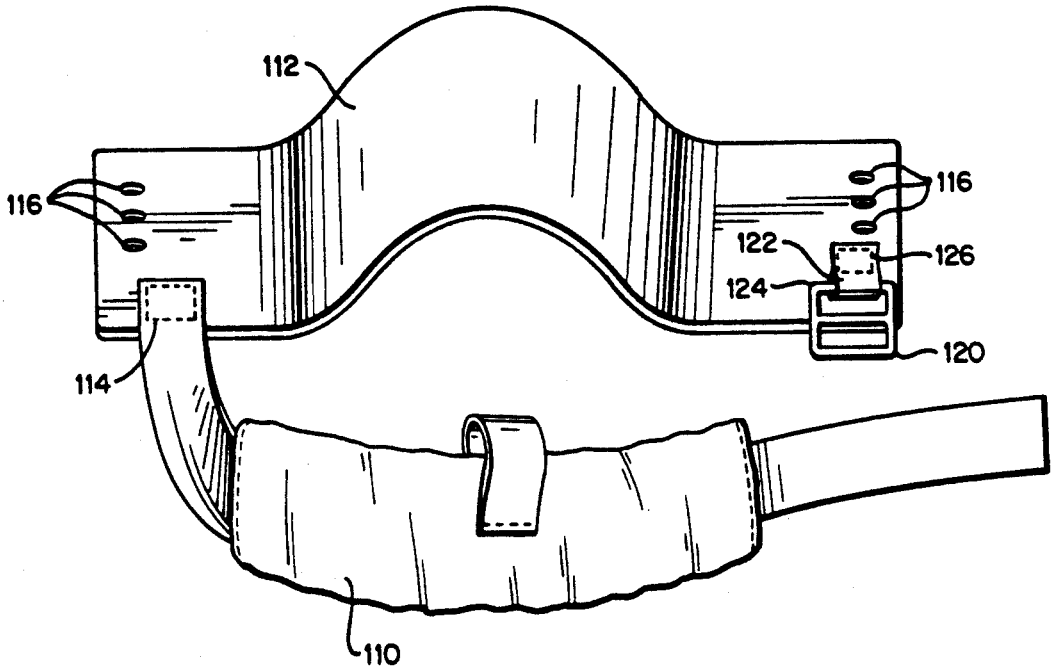
FIG. 4 is a perspective view of a preferred embodiment of the invention integrated with a foot strap and using a buckle.

Referring to FIG. 4, a preferred embodiment of the heel-binding device integrated with a foot strap configured to receive a human foot to form an integrated foot-binding device is shown. A heel-binding device 110 of any embodiment previously shown but without grommets in the anchors is connected to a foot strap 112 by sewing one end of heel-binding device 110 to one end of foot strap 112, preferably with nylon thread 114 to form a box as shown, in a manner leaving grommet(s) or screw hole(s) 116 on foot strap 112 uncovered. A buckle 120, of any conventional design and materials, preferably a cinch cleat buckle (which has opposing flat portions hinged together, with serrations along the hinged portions of the flat portions for gripping material placed between the flat portions near the hinge), is connected to the other end of foot strap 112, again leaving grommet(s) or screw hole(s) 116 uncovered, preferably by sewing a piece of nylon webbing 122 which folds over bar 124 of buckle 120 to the other end of foot strap 112, preferably with nylon thread 126. The other end of heel-binding device 110 is then releasably connected to buckle 120 in a manner permitting precise adjustment to the user's foot.

Figure 5:
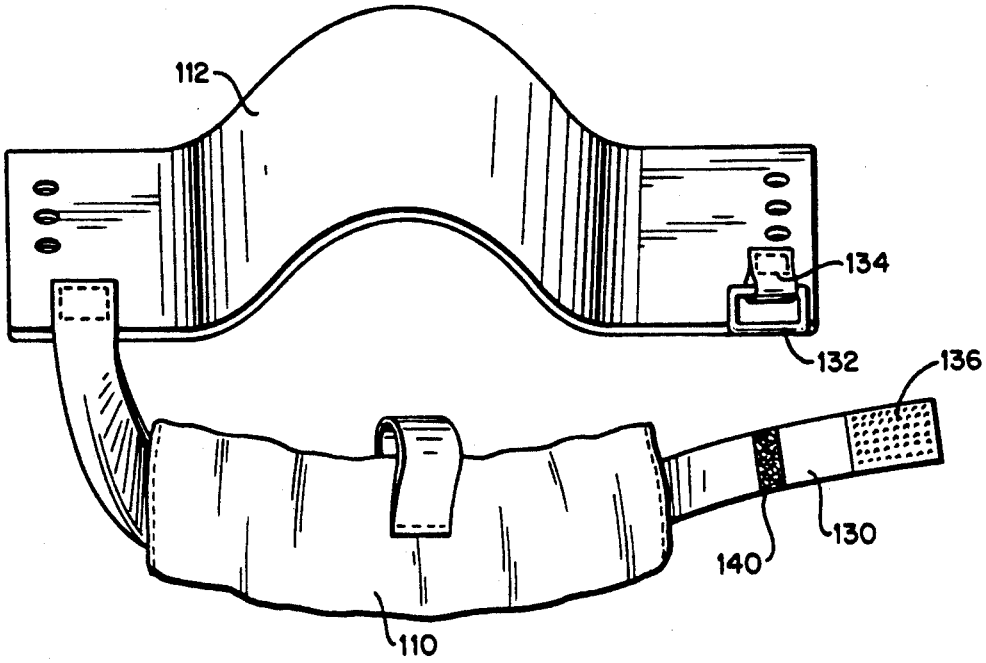
FIG. 5 is a perspective view of an alternative embodiment of the invention integrated with a foot strap and using a hook and loop fastener instead of a buckle.

Alternatively, a hook and loop fastener can be used to releasably connect heel-binding device 110 to foot strap 112, as shown in FIG. 5. In this embodiment, anchor 130 having loop section 136 and hook section 140 releasably connects with itself by inserting loop section 136 through an anchor receiving member (bar 132) and attaching it to hook section 140. Of course, the hook and loop sections can be interchanged.

This invention has been disclosed with respect to the preferred embodiments thereof. It will be obvious to those skilled in the art that changes and modifications can be made in the disclosed embodiments without departing from the spirit and scope of the invention. For example, the anchors can be made of other materials, including metal or plastic rings or links, or the elastic member can be attached directly to a foot strap, without anchors. The anchors also can be attached to the foot strap by other means that are equivalent to the disclosed means, such as by snaps or other fastening devices. Also, the heel straps can be detachably attached by attaching an anchor to the foot strap and providing a detachable fastener between the elastic member and the anchor. Accordingly, no limitations are to be implied or inferred except as specifically and explicitly set forth in the attached claims.

What is claimed is:

1. A heel binding device for binding a user's heel to a board having a top side, comprising:

an elastic member having a board end and a member end;

first member fastening means for fastening said member end of said first anchor to said first end of said elastic member;

a second anchor having a board end and a member end; and second member fastening means for fastening said member end of said second anchor to said second end of said elastic member;

first board attachment means for attaching said board end of said first anchor to said top side of said board;

wherein said first board attachment means comprises a plurality of grommets inserted into said first anchor.

2. A heel binding device for binding a user's heel to a board having a top side, comprising:

an elastic member having a first end and a second end;

a first anchor having a board end and a member end;

first member fastening means for fastening said member end of said first anchor to said first end of said elastic member;

a second anchor having a board end and a member end;

second member fastening means for fastening said member end of said second anchor to said second end of said elastic member;

wherein said elastic member comprises hollow latex rubber tubing having a first end and a second end.

3. A device according to claim 2, wherein said first end of said hollow latex rubber tubing is attached to said second end of said hollow latex rubber tubing to form an elongated loop having first and second shorter sides and wherein said anchors are attached to first and second shorter sides of said elongated loop.

4. A device according to claim 3, further comprising:

a cord having first and second ends, wherein first and second knots are tied in said first and second ends respectively, and wherein said first and second knots are inserted into said first and second ends of said hollow latex rubber tubing, respectively;

first retaining means tightened over said hollow latex rubber tubing abutting against said first knot between said first knot and said first end of said hollow latex rubber tubing for retaining said first knot inside said first end of said hollow latex rubber tubing; and second retaining means tightened over said hollow latex rubber tubing abutting against said second knot between said second knot and said second end of said hollow latex rubber tubing for retaining said second knot inside said second end of said hollow latex rubber tubing.

5. A device according to claim 4, wherein said first and second retaining means comprise zip ties.

6. A device according to claim 2, wherein said first anchor is attached to said first end of said hollow latex rubber tubing and wherein said second anchor is attached to said second end of said hollow latex rubber tubing.

7. A device according to claim 6, further comprising:

a first cord having first and second ends, wherein said first and second ends of said first cord are tied together to form a first knot, wherein said first cord forms a first loop, wherein said first anchor is attached to said first loop and wherein said first knot is inserted into said first end of said hollow latex rubber tubing;

first retaining means tightened over said hollow latex rubber tubing abutting against said first knot between said first knot and said first end of said hollow latex rubber tubing for retaining said first knot inside said first end of said hollow latex rubber tubing;

a second cord having first and second ends, wherein said first and second ends of said second cord are tied together to form a second know, wherein said second cord forms a second loop, wherein said second anchor is attached to said second loop and wherein said second knot is inserted into said second end of said hollow latex rubber tubing; and second retaining means tightened over said hollow latex rubber tubing abutting against said second knot between said second knot and said second end of said hollow latex rubber tubing for retaining said second knot inside said second end of said hollow latex rubber tubing.

8. A device according to claim 7, wherein said first and second retaining means comprise zip ties.

9. A heel binding device for binding a user's heel to a board having a top side, comprising:

an elastic member having a first end and a second end;

a first anchor having a board end and a member end;

first member fastening means for fastening said member end of said first anchor to said first end of said elastic member;

a second anchor having a board end and a member end; and second member fastening means for fastening said member end of said second anchor to said second end of said elastic member; and a sleeve surrounding said elastic member.

10. A device according to claim 9, wherein said sleeve comprises rubber.

11. A device according to claim 10, wherein said sleeve comprises neoprene rubber.

12. A device according to claim 9, further comprising:

a tab attached to said sleeve.

13. A device according to claim 12, wherein:

said tab comprises nylon webbing.

14. A device according to claim 9, wherein said sleeve comprises stretchable synthetic cloth.

15. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable foot strap attachment means comprises:

a buckle attached to said second end of said foot strap; and wherein said buckle comprises a cinch cleat buckle.

16. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable foot strap attachment means comprises:

a buckle attached to said foot strap end of said second anchor;

wherein said buckle comprises a cinch cleat buckle.

17. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable member fastening means;

wherein said releasable member fastening means comprises:

a buckle attached to said member end of said second anchor;

wherein said buckle comprises a cinch cleat buckle.

18. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member;

second foot strap attachment means for attaching said foot strap end of said second anchor to said second end of said foot strap;

wherein said second foot strap attachment means comprises releasable foot strap attachment means;

wherein said releasable member fastening means comprises:

a buckle attached to said second end of said elastic member;

wherein said buckle comprises a cinch cleat buckle.

19. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable member fastening means comprises:

an anchor receiving member attached to said second end of said elastic member;

a loop element of a hook and loop fastener attached adjacent to said member end of said second anchor; and a hook element of a hook and loop fastener attached to said second anchor between said loop element and said foot strap end, whereby said loop element can be received in said anchor receiving member and mated to said hook element.

20. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable member fastening means comprises:

an anchor receiving member attached to said second end of said elastic member;

a hook element of a hook and loop fastener attached adjacent to said member end of said second anchor; and a loop element of a hook and loop fastener attached to said second anchor between said hook element and said foot strap end, whereby said hook element can be received in said anchor receiving member and mated to said loop element.

21. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said releasable member fastening means comprises:

an elastic member receiving member attached to said member end of said second anchor;

a loop element of a hook and loop fastener attached adjacent to said member end of said second anchor; and a hook element of a hook and loop fastener attached to said second anchor between said loop element and said foot strap end, whereby said loop element can be received in said elastic member receiving member and mated to said hook element.

22. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member;

second foot strap attachment means for attaching said foot strap end of said second anchor to said second end of said foot strap;

wherein said second foot strap attachment means comprises releasable member fastening means;

wherein said releasable member fastening means comprises:

an elastic member receiving member attached to said member end of said second anchor;

a hook element of a hook and loop fastener attached adjacent to said member end of said second anchor; and a loop element of a hook and loop fastener attached to said second anchor between said hook element and said foot strap end, whereby said hook element can be received in said elastic member receiving member and mated to said loop element.

23. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said elastic member comprises hollow latex rubber tubing having a first end and a second end.

24. A device according to claim 23, wherein said first end of said hollow latex rubber tubing is attached to said second end of said hollow latex rubber tubing to form an elongated loop having first and second shorter sides and wherein said anchors are attached to first and second shorter sides of said elongated loop.

25. A device according to claim 24, further comprising:

a cord having first and second ends, wherein first and second knots are tied in said first and second ends respectively, and wherein said first and second knots are inserted into said first and second ends of said hollow latex rubber tubing, respectively;

first retaining means tightened over said hollow latex rubber tubing abutting against said first knot between said first knot and said first end of said hollow latex rubber tubing for retaining said first knot inside said first end of said hollow latex rubber tubing; and second retaining means tightened over said hollow latex rubber tubing abutting against said second knot between said second knot and said second end of said hollow latex rubber tubing for retaining said second knot inside said second end of said hollow latex rubber tubing.

26. A device according to claim 25, wherein said first and second retaining means comprise zip ties.

27. A device according to claim 23 wherein said first anchor is attached to said first end of said hollow latex rubber tubing and wherein said second anchor is attached to said second end of said hollow latex rubber tubing.

28. A device according to claim 27, further comprising:

a first cord having first and second ends, wherein said first and second ends of said first cord are tied together to form a first knot, wherein said first cord forms a first loop, wherein said first anchor is attached to said first loop and wherein said first know is inserted into said first end of said hollow latex rubber tubing;

first retaining means tightened over said hollow latex rubber tubing abutting against said first knot between said first knot and said first end of said hollow latex rubber tubing for retaining said first knot inside said first end of said hollow latex rubber tubing;

a second cord having first and second ends, wherein said first and second ends of said second cord are tied together to form a second knot, wherein said second cord forms a second loop, wherein said second anchor is attached to said second loop and wherein said second knot is inserted into said second end of said hollow latex rubber tubing; and second retaining means tightened over said hollow latex rubber tubing abutting against said second knot between said second knot and said second end of said hollow latex rubber tubing for retaining and second knot inside said second end of said hollow latex rubber tubing.

29. A device according to claim 28, wherein said first and second retaining means comprise zip ties.

30. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said elastic member comprises hollow latex rubber tubing having a first end and a second end.

31. A device according to claim 30, wherein said first end of said hollow latex rubber tubing is attached to said second end of said hollow latex rubber tubing to form an elongated loop having first and second shorter sides and wherein said anchors are attached to first and second shorter sides of said elongated loop.

32. A device according to claim 31, further comprising:

a cord having first and second ends, wherein first and second knots are tied in said first and second ends respectively, and wherein said first and second knots are inserted into said first and second ends of said hollow latex rubber tubing, respectively;

first retaining means tightened over said hollow latex rubber tubing abutting against said first knot between said first knot and said first end of said hollow latex rubber tubing for retaining said first know inside said first end of said hollow latex rubber tubing; and second retaining means tightened over said hollow latex rubber tubing abutting against said second knot between said second knot and said second end of said hollow latex rubber tubing for retaining said second knot inside said second end of said hollow latex rubber tubing.

33. A device according to claim 32, wherein said first and second retaining means comprise zip ties.

34. A device according to claim 30, wherein said first anchor is attached to said first end of said hollow latex rubber tubing and wherein said second anchor is attached to said second end of said hollow latex rubber tubing.

35. A device according to claim 34, further comprising:

a first cord having first and second ends, wherein said first and second ends of said first cord are tied together to form a first knot, wherein said first cord forms a first loop, wherein said first anchor is attached to said first loop and wherein said first knot is inserted into said first end of said hollow latex rubber tubing;

first retaining means tightened over said hollow latex rubber tubing abutting against said first knot between said first knot and said first end of said hollow latex rubber tubing for retaining said first knot inside said first end of said hollow latex rubber tubing;

a second cord having first and second ends, wherein said first and second ends of said second cord are tied together to form a second knot, wherein said second cord forms a second loop, wherein said second anchor is attached to said second loop and wherein said second knot is inserted into said second end of said hollow latex rubber tubing; and second retaining means tightened over said hollow latex rubber tubing abutting against said second knot between said for retaining said second knot inside said second end of said hollow latex rubber tubing.

36. A device according to claim 35, wherein said first and second retaining means comprise zip ties.

37. A heel binding device for binding a user's heel to a board having a top side, comprising:

a foot strap configured to receive a human foot having first and second ends adapted to be attached to said top side of said board, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member;

second foot strap attachment means for attaching said foot strap end of said second anchor to said second end of said foot strap;

a sleeve surrounding said elastic member.

38. A device according to claim 37, wherein said sleeve comprises a rubber.

39. A device according to claim 38, wherein said sleeve comprises neoprene rubber.

40. A device according to claim 37, further comprising: a tap attached to said sleeve.

41. A device according to claim 40, wherein: said tap comprises nylon webbing.

42. A device according to claim 37, wherein said sleeve comprises stretchable synthetic cloth.

43. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap; and a sleeve surrounding said elastic member.

44. A device according to claim 43, wherein said sleeve comprises rubber.

45. A device according to claim 44, wherein said sleeve comprises neoprene rubber.

46. A device according to claim 43, further comprising:

a tab attached to said sleeve.

47. A device according to claim 46, wherein:

said tab comprises nylon webbing.

48. A device according to claim 43, wherein said sleeve comprises stretchable synthetic cloth.

49. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable foot strap attachment means comprises:

a buckle attached to said second end of said foot strap; and wherein said buckle comprises a cinch cleat buckle.

50. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second foot strap attachment means comprises releasable foot strap attachment means;

wherein said releasable foot strap attachment means comprises:

a buckle attached to said foot strap end of said second anchor;

wherein said buckle comprises a cinch cleat buckle.

51. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second member fastening means comprises releasable member fastening means;

wherein said releasable member fastening means comprises:

a buckle attached to said second end of said elastic member; and wherein said buckle comprises a cinch cleat buckle.

52. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member;

second foot strap attachment means for attaching said foot strap end of said second anchor to said second end of said foot strap;

wherein said second foot strap attachment means comprises releasable member fastening means;

wherein said releasable member fastening means comprises:

a buckle attached to said member end of said second anchor; and wherein said buckle comprises a cinch cleat buckle.

53. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second member fastening means comprises releasable member fastening means;

wherein said releasable member fastening means comprises:

an anchor receiving member attached to said second end of said elastic member;

a loop element of a hook and loop fastener attached adjacent to said member end of said second anchor; and a hook element of a hook and loop fastener attached to said second anchor between said loop element and said foot strap end, whereby said loop element can be received in said anchor receiving member and mated to said hook element.

54. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second member fastening means comprises releasable member fastening means;

wherein said releasable member fastening means comprises:

an anchor receiving member attached to said second end of said elastic member;

a hook element of a hook and loop fastener attached adjacent to said member end of said second anchor; and a loop element of a hook and loop fastener attached to said second anchor between said hook element and said foot strap end, whereby said hook element can be received in said anchor receiving member and mated to said loop element.

55. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second member fastening means comprises releasable member fastening means;

wherein said releasable member fastening means comprises:

an elastic member receiving member attached to said member end of said second anchor;

a loop element of a hook and loop fastener attached adjacent to said member end of said second anchor; and a hook element of a hook and loop fastener attached to said second anchor between said loop element and said foot strap end, whereby said loop element can be received in said elastic member receiving member and mated to said hook element.

56. An improved sporting board device, comprising:

a board having a top side;

a foot strap configured to receive a human foot having first and second ends attached to said top side of said board at said first and second ends, said first and second ends defining a distance slightly greater than the width of a human foot;

an elastic member having a first end and a second end;

a first anchor having a foot strap end and a member end;

first member fastening means for fastening said member end of said first anchor to said first end of said elastic member;

first foot strap attachment means for attaching said foot strap end of said first anchor to said first end of said foot strap;

a second anchor having a foot strap end and a member end;

second member fastening means for fastening said member end of said second anchor to said second end of said elastic member; and second foot strap attachment means for attaching said foot strap end of said second anchor to said second end of said foot strap;

wherein said second member fastening means comprises releasable member fastening means;

wherein said releasable member fastening means comprises:

an elastic member receiving member attached to said member end of said second anchor;

a hook element of a hook and loop fastener attached adjacent to said member end of said second anchor; and a loop element of a hook and loop fastener attached to said second anchor between said hook element and said foot strap end, whereby said hook element can be received in said elastic member receiving member and mated to said loop element.

* * * * *